US007098768B2

(12) United States Patent
Doi

(10) Patent No.: US 7,098,768 B2
(45) Date of Patent: Aug. 29, 2006

(54) CHIP RESISTOR AND METHOD FOR MAKING THE SAME

(75) Inventor: Masato Doi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/496,953

(22) PCT Filed: Nov. 28, 2002

(86) PCT No.: PCT/JP02/12407

§ 371 (c)(1),
(2), (4) Date: May 26, 2004

(87) PCT Pub. No.: WO03/046934

PCT Pub. Date: Jun. 5, 2003

(65) Prior Publication Data

US 2004/0262712 A1 Dec. 30, 2004

(30) Foreign Application Priority Data

Nov. 28, 2001 (JP) ..... 2001-362650

(51) Int. Cl.
*H01C 1/012* (2006.01)

(52) U.S. Cl. ..... 338/309; 338/314; 338/328

(58) Field of Classification Search ..... 338/307, 338/309, 313, 314, 328, 322, 308; 29/610.1, 29/617, 620

See application file for complete search history.

(56) References Cited

U.S. PATENT DOCUMENTS 5,379,017 A * 1/1995 Katsuno ..... 338/332
5,917,403 A * 6/1999 Hashimoto et al. ..... 338/307
5,966,067 A * 10/1999 Murakami et al. ..... 338/309
6,127,722 A * 10/2000 Doi et al. ..... 257/536
6,492,896 B1 * 12/2002 Yoneda ..... 338/309
6,636,143 B1 * 10/2003 Hashimoto et al. ..... 338/309
2001/0000215 A1 * 4/2001 Oh ..... 338/306

FOREIGN PATENT DOCUMENTS

| | | | |
|---|---|---|---|
| JP | 56-148804 | | 11/1981 |
| JP | 57-7915 | | 1/1982 |
| JP | 8-236302 | | 9/1996 |
| JP | 2001-23801 | * | 1/2001 |
| JP | 2001-110601 | | 4/2001 |

* cited by examiner

*Primary Examiner*—Tu Hoang
(74) *Attorney, Agent, or Firm*—Hamre, Schumann, Mueller & Larson, P.C.

(57) ABSTRACT

A chip resistor includes: an insulating chip substrate 11 having an upper surface formed with a resistive film 12 and a pair of left and right upper electrodes 13 at two ends thereof; a cover coat 14 covering the resistive film; auxiliary upper electrodes 15 formed on upper surfaces of the upper electrodes 13 to overlap the cover coat 14; a left and a right side electrodes 16 formed on a left and a right end surfaces 11*a* of the insulating substrate 11; and metal plate layers formed on surfaces of the auxiliary upper electrodes and side electrodes. The cover coat 14 is formed with an uppermost over coat 19 covering a region where the auxiliary upper electrodes 15 overlap the cover coat 14, whereby the upper electrodes 13 and the auxiliary upper electrodes 15 are protected from migration caused by sulfur gases.

9 Claims, 5 Drawing Sheets

CHIP RESISTOR AND METHOD FOR MAKING THE SAME

TECHNICAL FIELD PERTINENT TO THE INVENTION

The present invention relates to a chip resistor including an insulating chip substrate formed with at least one resistive film, terminal electrodes at two ends of the resistive film, and a cover coat covering the resistive film. The present invention also relates to a method of making the chip resistor.

BACKGROUND ART AND PROBLEMS TO BE SOLVED BY THE INVENTION

Conventionally, as disclosed in the Japanese Patent Laid-Open No. 56-148804 for example, chip resistors of this kind have the cover coat protruding high at a center region on an upper surface of the insulating substrate. When the chip resistor is sucked by a vacuum collet, it is sometimes impossible to suck, or the cover coat is cracked for example, from time to time.

This problem has been solved in a recent chip resistor which is made according to a prior art disclosed in the Japanese Patent Laid-Open No. 8-236302 and as shown in FIG. 1.

Specifically, this chip resistor includes an insulating chip substrate 1 having an upper surface formed with a resistive film 2, a pair of left and right upper electrodes 3 at two ends of the resistive film, a cover coat 4 made of glass for example, covering the resistive film 2, auxiliary upper electrodes 5 on the upper electrodes 3, overlapping the cover coat 4, and side electrodes 6 on a left and a right side surfaces of the insulating substrate 1, making electrical connection with the upper electrodes 3 and the auxiliary upper electrodes 5. With this construction, the cover coat 4 is prevented from protruding or becoming high by the auxiliary upper electrodes 5 formed on the upper electrodes 3.

The insulating substrate 1 has a lower surface formed with a pair of lower electrodes 7 which are electrically connected with the side electrodes 6. The entire surfaces of the auxiliary upper electrodes 5, side electrodes 6 and lower electrodes 7 are coated with metal plate layers 8 made of a nickel plate layer and a solder or tin plate layer formed on the nickel plate layer.

However, according to the prior art, the auxiliary upper electrodes 5 are made just the same way as the upper electrodes 3 are formed at the ends of the resistive film 2, i.e. by first applying an electrically conductive paste of silver (hereinafter simply called silver paste) which is a paste containing silver as a primary component having a low electrical resistance, and then sintering the paste. Although the auxiliary upper electrodes 5 are coated with the metal plate layers 8, the metal plate layers 8 do not have perfect fit to the cover coat, allowing sulfur gases such as hydrogen sulfide in the atmosphere to find ways between the metal plate layer and the cover coat to a region where the auxiliary upper electrodes 5 made from the silver paste overlap the cover coat, causing migration of the metal or other forms of corrosion. When the corrosion reaches the upper electrodes 3, electrical resistance of the resistor is altered, and furthermore, the upper electrodes 3 are electrically disconnected eventually.

The present invention aims at providing a chip resistor which does not have the above problem, and a method of making the chip resistor.

DISCLOSURE OF THE INVENTION

A first aspect of the present invention provides a chip resistor including: an insulating chip substrate having an upper surface formed with at least one resistive film and a pair of left and right upper electrodes at two ends of the resistive film; a cover coat covering the resistive film; auxiliary upper electrodes formed on upper surfaces of the upper electrodes and overlapping the cover coat; a left and a right side electrodes formed on a left and a right end surfaces of the insulating substrate and made electrically connected with the upper electrodes and the auxiliary upper electrodes; and a metal plate layer formed on surfaces of the auxiliary upper electrodes and side electrodes. The cover coat has an upper surface formed with an uppermost over coat covering a region where the auxiliary upper electrodes overlap the cover coat.

With the above construction, parts of the auxiliary upper electrodes overlapping the cover coat are covered by the uppermost over coat, which protects these parts, i.e. parts of the auxiliary upper electrodes which overlap the cover coat reliably from invasion by sulfur gases such as hydrogen sulfide in the atmosphere. This means that occurrence of migration and other forms of corrosion in these parts can be reliably prevented, and therefore it becomes possible to reliably prevent disconnection in the upper electrodes which are made of electrically highly conductive silver, or alteration of resistance value, due to sulfur gases.

A second aspect of the present invention characterizes the first aspect by that the auxiliary upper electrodes on the upper electrodes are formed from: a sintering-type electrically conductive paste primarily made of a base metal such as nickel and copper; a hardening-type electrically conductive paste containing a base metal such as nickel and copper as an agent which provides electrical conductivity; or a hardening-type electrically conductive paste containing carbon as an agent which provides electrical conductivity.

With the above arrangement, since the auxiliary upper electrodes are formed from either a sintering-type electrically conductive paste primarily made of a base metal such as nickel and copper or a hardening-type electrically conductive paste containing a base metal such as nickel and copper as an agent which provides electrical conductivity, there is extremely low probability that migration or other forms of corrosion occurs in part of the auxiliary upper electrodes overlapping the cover coat. Or, since the auxiliary upper electrodes on the upper electrodes are formed from a hardening-type electrically conductive paste containing carbon as an agent which provides electrical conductivity, there is no probability that migration or other forms of corrosion occurs in part of the auxiliary upper electrodes overlapping the cover coat. In either case, the above-described advantage can be enhanced.

A third aspect of the present invention relates to a method of making a chip resistor of the above construction. The method includes: a step of forming at least one resistive film and a pair of left and right upper electrodes at two ends of the resistive film on an upper surface of an insulating chip substrate; a step of forming a cover coat covering the resistive film on the upper surface of the insulating substrate; a step of forming auxiliary upper electrodes on the upper electrodes so as to overlap the cover coat; a step of forming side electrodes on two end surfaces of the insulating substrate, making electric connection with at least the upper electrodes; a step of forming an uppermost over coat on an upper surface of the cover coat, covering a region where the auxiliary upper electrodes overlap the cover coat; and a step of forming a metal plate layer on surfaces of the auxiliary upper electrodes and side electrodes.

The method enables to make chip resistors having the advantages described earlier.

BEST MODE FOR CARRYING OUT THE INVENTION

Hereinafter, embodiments of the present invention will be described with reference to the drawings.

Figure 1:
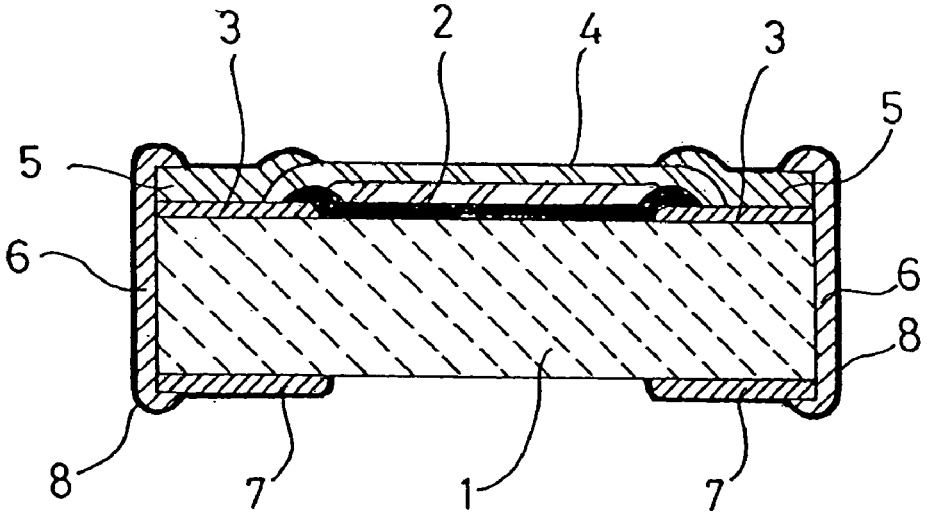
FIG. 1 is a front view showing a vertical section of a conventional chip resistor.
Figure 2:
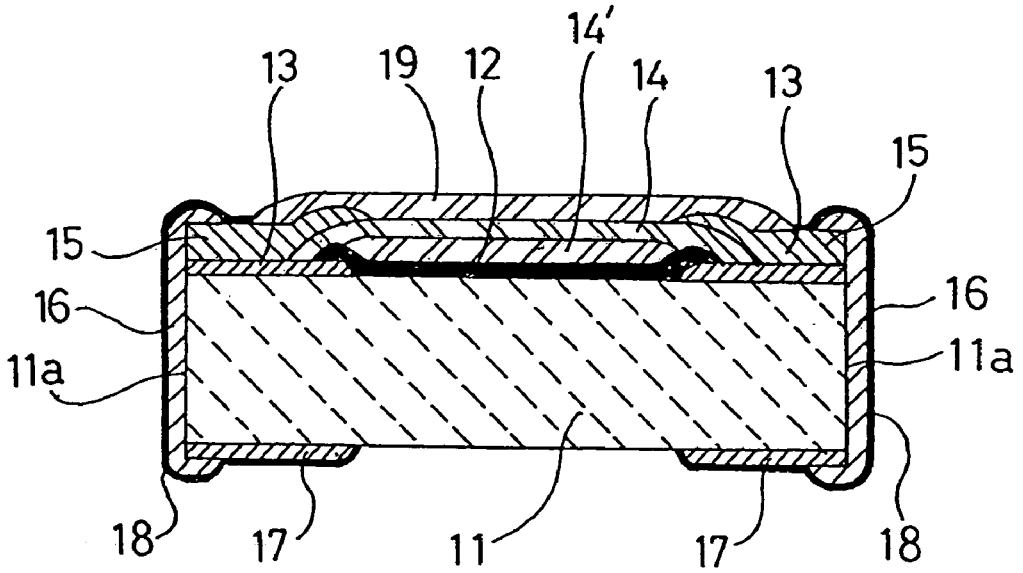
FIG. 2 is a front view showing a vertical section of a chip resistor according to an embodiment of the present invention.

FIG. 2 shows a chip resistor according to an embodiment of the present embodiment.

The chip resistor according to this embodiment includes an insulating chip substrate 11 having a lower surface formed with a pair of left and right lower electrodes 17 made from a silver paste. The insulating substrate 11 also has an upper surface formed with a resistive film 12 and upper electrodes 13 made from a silver paste at two ends of the resistive film, and a cover coat 14 made of glass for example, covering the resistive film 12. The upper electrodes 13 have upper surfaces formed with auxiliary upper electrodes 15 made from: a silver paste; another electrically conductive paste primarily made of a base metal such as nickel and copper; or a hardening-type electrically conductive resin paste to be described later, overlapping the cover coat 14. Further, the cover coat 14 has an upper surface covered by an uppermost overcoat 19 made of glass or thermosetting synthetic resin, covering a region where the auxiliary upper electrodes 15 overlap the cover coat 14. The insulating substrate 11 has a left and a right end surfaces 11*a* formed with side electrodes 16 made from a silver paste or another electrically conductive resin paste, making electrical connection with the upper electrodes 13, the auxiliary upper electrodes 15 and the lower electrodes 17. Surfaces of the auxiliary upper electrodes 15, the side electrodes 16 and the lower electrodes 17 are coated with metal plate layers 18 made of a nickel plate layer and a solder or tin plate layer formed on the nickel plate layer.

By providing the uppermost over coat 19 on the upper surface of the cover coat 14, to cover a region where the auxiliary upper electrodes 15 overlap the cover coat 14, parts of the auxiliary upper electrodes 15 overlapping the cover coat 14 are coated with the uppermost over coat 19, thereby reliably protected from invasion by sulfur gases such as hydrogen sulfide in the atmosphere. This enables to reliably prevent migration and other forms of corrosion from occurring in the region.

In particular, according to the embodiment described above, the auxiliary upper electrodes 15 may be formed of an electrically conductive paste primarily made of a base metal such as nickel and copper which have extremely low probability for migration or other forms of corrosion caused by sulfur gases. Therefore, occurrence of migration and other forms of corrosion in a region where the auxiliary upper electrodes 15 overlap the cover coat 14 can be reliably reduced.

Alternatively, the auxiliary upper electrodes 15 may not be formed from a sintering-type electrically conductive paste primarily made of a base metal such as nickel and copper. Specifically, the formation may be made by using a hardening-type electrically conductive paste containing a base metal such as nickel and copper as a component which provides electric conductivity.

Still further, the auxiliary upper electrodes 15 may be formed from a hardening-type electrically conductive paste containing carbon as a component which provides electric conductivity.

Electrically conductive resin paste of this kind, which contains carbon as a component which provides electric conductivity, is not susceptible to migration or other forms of corrosion caused by sulfur gases. Therefore, occurrence of migration and other forms of corrosion in the region where the auxiliary upper electrodes 15 overlap the cover coat 14 can be prevented more reliably.

FIG. 3 through FIG. 9 show a method of manufacturing the chip resistor according to the above embodiment.

Figure 3:
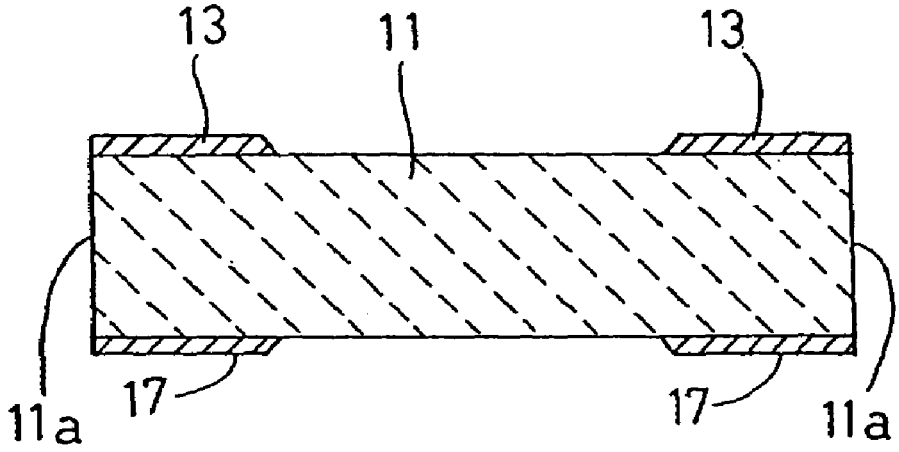
FIG. 3 shows a first step of manufacturing the chip resistor according to the embodiment.

The method includes the following steps:

(1) First, as shown in FIG. 3, a pair of lower electrodes 17 is formed on a lower surface of an insulating substrate 11 and a pair of upper electrodes 13 is formed on an upper surface of the insulating substrate 11, by first applying a silver paste in screen printing and then sintering the paste at a predetermined temperature.

Figure 4:
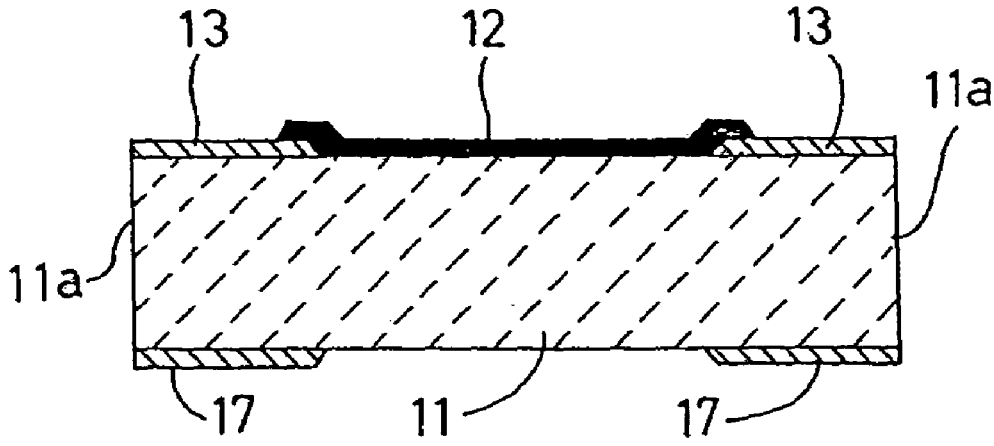
FIG. 4 shows a second step.

(2) Next, as shown is FIG. 4, a resistive film 12 is formed on the upper surface of the insulating substrate 11, by first applying a predetermined material paste in screen printing and then sintering the paste at a predetermined temperature.

It should be noted here that the step of forming the resistive film 12 may alternatively be performed before the step of forming the upper electrodes 13, and the step of forming the upper electrodes 13 may be performed thereafter.

Figure 5:
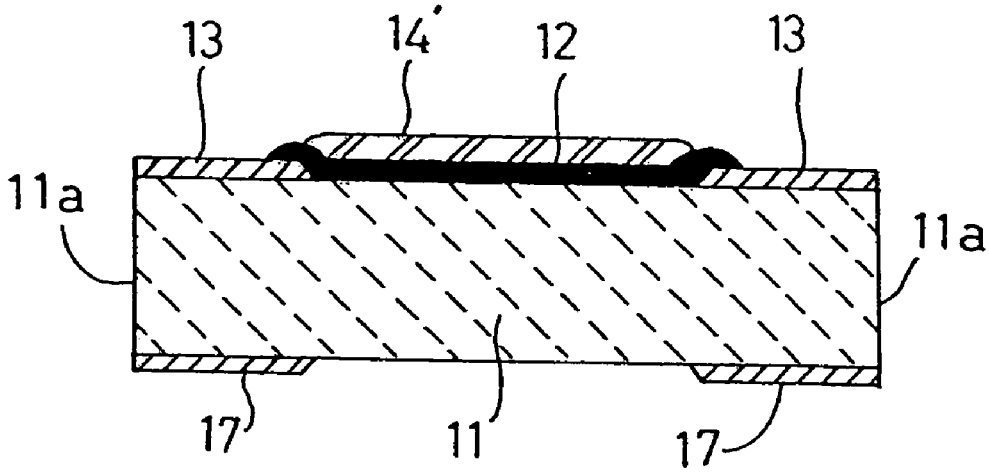
FIG. 5 shows a third step.

(3) Next, as shown is FIG. 5, a glass under coat 14' is formed on the resistive film 12, by first applying a predetermined material paste in screen printing and then sintering the paste at a predetermined temperature.

(4) Next, a trimming adjustment is made by applying a laser beam for example to the resistive film 12 through the under coat 14', to form a trimming groove thereby adjusting electrical resistance to a predetermined value.

Figure 6:
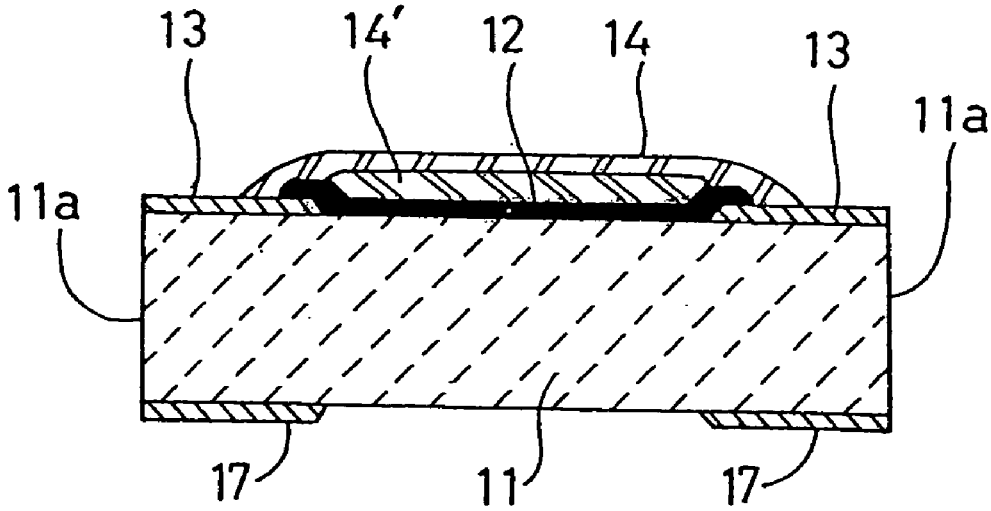
FIG. 6 shows a fourth step.

(5) Next, as shown is FIG. 6, a glass cover coat 14 is formed on the upper surface of the insulating substrate 11 to cover the resistive film 12 and the under coat 14' entirely, by first applying a predetermined material paste in screen printing and then sintering the paste at a predetermined temperature.

Figure 7:
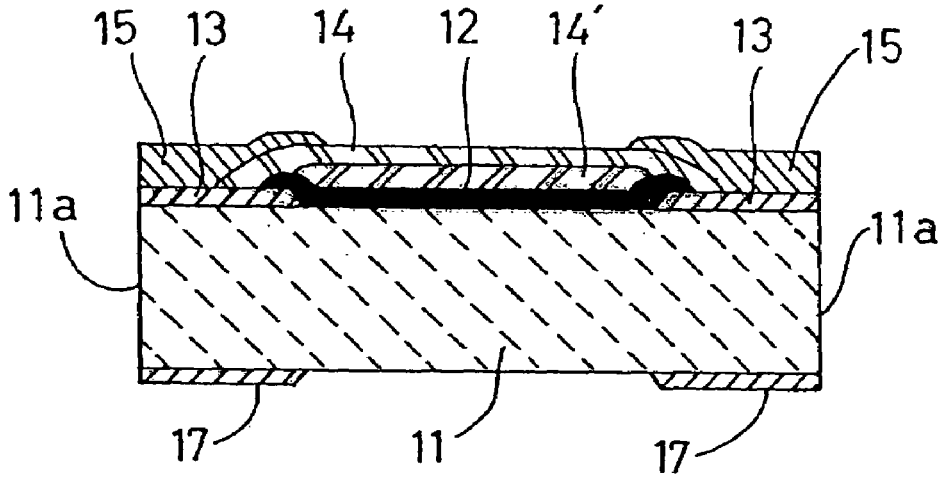
FIG. 7 shows a fifth step.

(6) Next, as shown is FIG. 7, thick auxiliary upper electrodes 15 are formed on upper surfaces of the upper electrodes 13 so as to overlap the cover coat 14, by first applying a silver paste or another electrically conductive paste primarily made of a base metal such as nickel or copper in screen printing and then sintering the paste at a predetermined temperature.

Figure 8:
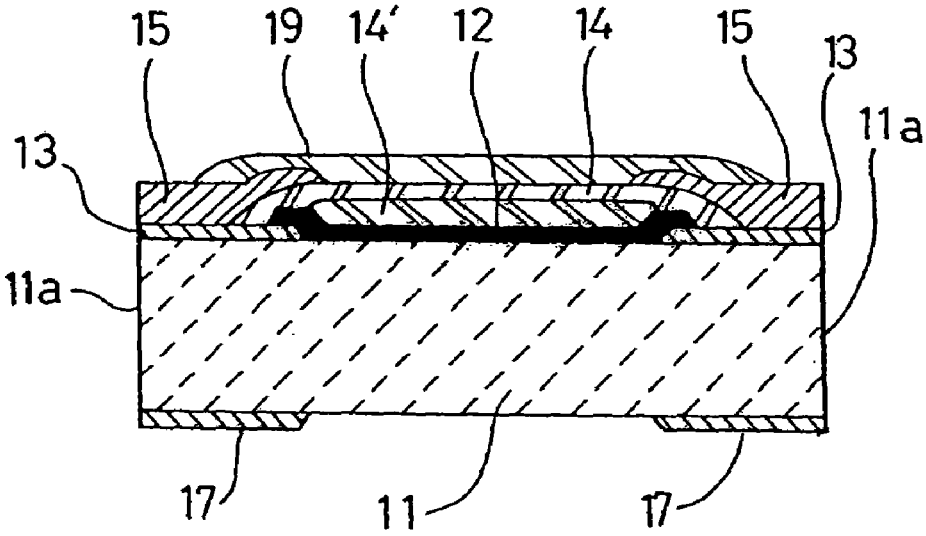
FIG. 8 shows a sixth step.

(7) Next, as shown is FIG. 8, an uppermost glass over coat 19 is formed on an upper surface of the cover coat 14 to cover a region where the auxiliary upper electrodes 15 overlap the cover coat 14, by first applying a predetermined material paste in screen printing and then sintering the paste at a predetermined temperature.

Figure 9:
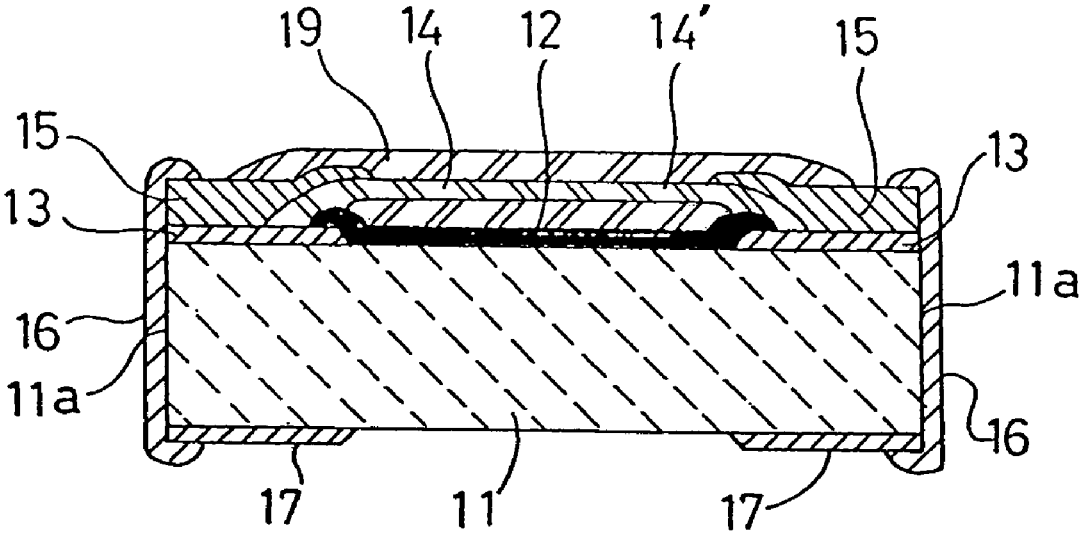
FIG. 9 shows a seventh step.

(8) Next, as shown is FIG. 9, side electrodes 16 are formed on a left and a right end surfaces 11*a* of the insulating substrate 11 so that the side electrodes 16 overlap upper surfaces of the auxiliary upper electrodes 15 and lower surfaces of the lower electrodes 17, by first applying an electrically conductive paste such as silver paste in screen printing and then sintering the paste at a predetermined temperature.

(9) Then, metal plate layers 18 including a nickel plate layer and a solder or tin layer for example are formed in barrel plating on surfaces of the auxiliary upper electrodes 15, side electrodes 16 and lower electrodes 17.

Through these steps, the chip resistor having a construction shown in FIG. 2 can be manufactured.

It should be noted that the step of forming the uppermost over coat 19 may be switched with the step of forming the side electrodes 16.

In another mode of embodiment, the uppermost over coat 19 may be made of a thermosetting synthetic resin.

In this case, i.e. if the uppermost over coat 19 is made of a thermosetting synthetic resin, one of the following two methods can be used.

In a first method, after the step (6) of the above described steps 1 through 9 has been completed, (i.e. after the auxiliary upper electrodes 15 have been formed), the side electrodes 16 are formed by first applying an electrically conductive paste such as silver paste in screen printing and then sintering the paste at a predetermined temperature. Then, an over coat 19 is formed of the synthetic resin by first applying a predetermined material paste in screen printing and then hardening the paste through drying for example at a temperature lower than the sintering temperature for the electrically conductive paste. After this, the metal plate layer 18 is formed.

In a second method, after the step (6) has been completed, an over coat 19 is formed of the synthetic resin by first applying a predetermined material paste in screen printing and then hardening the paste through drying for example at a temperature lower than the sintering temperature for the electrically conductive paste. Then, the side electrodes 16 are formed by first applying a predetermined hardening-type electrically conductive resin paste which is given electrical conductivity by one or more metal components in screen printing and then sintering the paste at a predetermined temperature. Then, the metal plate layer 18 is formed.

If the formation of the auxiliary upper electrodes 15 is made not with a sintered silver paste or another electrically conductive paste primarily made of a base metal such as nickel and copper, i.e. if the use of a sintering-type paste is replaced by the use of a hardening-type electrically conductive resin paste containing carbon as a component which provides electrical conductivity, the uppermost over coat 19 is formed of a thermosetting resin, and the side electrodes 16 are formed of a hardening-type electrically conductive resin paste which is given electrical conductivity by one or more metal components.

Specifically, after the step (5) of the above described steps 1 through 9 has been completed, (i.e. after the cover coat 14 has been formed), auxiliary upper electrodes 15 are formed on the upper surfaces of the upper electrodes 13 by first applying a hardening-type electrically conductive resin paste which is given electrical conductivity by carbon, and then hardening the paste through drying for example. Then, the side electrodes 16 are formed by first applying a hardening type electrically conductive resin paste and then hardening the paste through drying for example. After this, the over coat 19 is formed by first applying a predetermined material paste in screen printing and then hardening the paste through drying for example. Alternatively, the over coat 19 is formed by first applying a predetermined material paste in screen printing and then hardening the paste through drying for example, and then the side electrodes 16 are formed by first applying a hardening type electrically conductive resin paste, and then hardening the paste through drying for example. After whichever of the above has been performed, formation of the metal plate layer 18 is performed.

Still further, according to another embodiment, the formation of the auxiliary upper electrodes 15 is not made by applying and sintering an electrically conductive paste primarily made of a base metal such as nickel and copper: Specifically, the use of a sintering-type paste is replaced by the use of a hardening-type electrically conductive resin paste which is given electrical conductivity by a base metal such as nickel and copper.

In this case, after the step (5), auxiliary upper electrodes 15 are formed on the upper surfaces of the upper electrodes 13 by first applying the hardening-type electrically conductive resin paste and then hardening the paste. Then, side electrodes 16 are formed by first applying a hardening type electrically conductive resin paste and then hardening the paste. After this, the over coat 19 is formed by first applying a predetermined material paste in screen printing and then hardening the paste. Alternatively, the over coat 19 is formed by first applying a predetermined material paste in screen printing and then hardening the paste, and then the side electrodes 16 are formed by first applying a hardening-type electrically conductive resin paste and then hardening the paste. After whichever of the above has been performed, formation of the metal plate layer 18 is performed.

The invention claimed is:

1. A chip resistor comprising:

an insulating chip substrate having an upper surface formed with at least one resistive film and a pair of upper electrodes at two ends of the resistive film, the upper electrodes having inner edges directed toward each other;

a cover coat covering the resistive film and having edges extending onto the upper electrodes; auxiliary upper electrodes formed on upper surfaces of the upper electrodes and overlapping the cover coat, the auxiliary upper electrodes having inner edges directed toward each other;

side electrodes formed on end surfaces of the insulating substrate and electrically connected with the upper electrodes and the auxiliary upper electrodes; and metal plate layers formed on surfaces of the auxiliary upper electrodes and side electrodes;

wherein the cover coat has an upper surface formed with an uppermost over coat covering a region where the auxiliary upper electrodes overlap the cover coat;

wherein the over coat extends beyond said edges of the cover coat toward said end surfaces of the insulating substrate; and wherein the inner edges of the auxiliary upper electrodes extend toward each other beyond the inner edges of the upper electrodes.

2. The chip resistor according to claim 1, wherein the auxiliary upper electrodes on the upper electrodes are formed from a sintering-type electrically conductive paste primarily made of a base metal.

3. The chip resistor according to claim 1, wherein the auxiliary upper electrodes on the upper electrodes are formed from a hardening-type electrically conductive paste containing a base metal as an agent which provides electrical conductivity.

4. The chip resistor according to claim 1, wherein the auxiliary upper electrodes on the upper electrodes are formed from a hardening-type electrically conductive paste containing carbon as an agent which provides electrical conductivity.

5. A method of making a chip resistor, including comprising the steps of:

forming at least one resistive film and a pair of left and right upper electrodes at two ends of the resistive film on an upper surface of an insulating chip substrate, the upper electrodes having inner edges directed toward each other;

forming a cover coat covering the resistive film on the upper surface of the insulating substrate and having edges extending onto the upper electrodes;

forming auxiliary upper electrodes on the upper electrodes so as to overlap the cover coat, the auxiliary upper electrodes having inner edges directed toward each other;

forming side electrodes on two end surfaces of the insulating substrate for making electric connection with at least the upper electrodes;

forming an uppermost over coat on an upper surface of the cover coat for covering a region where the auxiliary upper electrodes overlap the cover coat, the over coat extending beyond said edges of the cover coat toward said end surfaces of the insulating substrate; and forming metal plate layers on surfaces of the auxiliary upper electrodes and side electrodes;

wherein the auxiliary upper electrodes are formed in a manner such that the inner edges of the auxiliary upper electrodes extend toward each other beyond the inner edges of the upper electrodes.

6. The chip resistor according to claim 1, wherein each of the auxiliary upper electrodes has an upwardly projecting edge overlapping the cover coat, the over coat extending beyond said edge of said each auxiliary electrode cover coat toward a respective end surface of the insulating substrate.

7. The method according to claim 5, wherein each of the auxiliary upper electrodes has an upwardly projecting edge overlapping the cover coat, the over coat extending beyond said edge of said each auxiliary electrode cover coat toward a respective end surface of the insulating substrate.

8. The chip resistor according to claim 2, wherein the base metal is selected from nickel or copper.

9. The chip resistor according to claim 3, wherein the base metal is selected from nickel or copper.

* * * * *